US011553762B2

(12) United States Patent
Stanley et al.

(10) Patent No.: US 11,553,762 B2
(45) Date of Patent: Jan. 17, 2023

(54) ACCESSORY WITH TIGHT PULL STRAP FOR ENCIRCLING ATTACHMENT TO OTHER OBJECTS

(71) Applicants: Robert John Stanley, Prospect Heights, IL (US); Jacquelynn Rae Stanley, Playa Del Rey, CA (US)

(72) Inventors: Robert John Stanley, Prospect Heights, IL (US); Jacquelynn Rae Stanley, Playa Del Rey, CA (US)

( * ) Notice: Subject to any disclaimer, the term of this patent is extended or adjusted under 35 U.S.C. 154(b) by 106 days.

(21) Appl. No.: 16/799,742

(22) Filed: Feb. 24, 2020

(65) Prior Publication Data

US 2020/0187598 A1 Jun. 18, 2020

Related U.S. Application Data

(63) Continuation-in-part of application No. 15/889,448, filed on Feb. 6, 2018, now Pat. No. 10,568,388, which is a continuation-in-part of application No. 15/622,454, filed on Jun. 14, 2017, now abandoned.

(51) Int. Cl.

| | |
|---|---|
| ***A43B 23/24*** | (2006.01) |
| ***A43B 23/00*** | (2006.01) |
| ***A43C 11/24*** | (2006.01) |
| ***A43C 7/08*** | (2006.01) |

(52) U.S. Cl.

CPC ..... *A43C 11/24* (2013.01); *A43C 7/08* (2013.01)

(58) Field of Classification Search

CPC ..... A43C 11/24; A43C 7/08

See application file for complete search history.

(56) References Cited

U.S. PATENT DOCUMENTS

| | | | | |
|---|---|---|---|---|
| 4,114,297 | A * | 9/1978 | Famolare, Jr. ..... | A43C 11/008 24/306 |
| 4,414,761 | A * | 11/1983 | Mahood ..... | A43C 1/00 24/712 |
| 4,780,936 | A * | 11/1988 | Brecher ..... | A43C 7/005 24/306 |
| 6,952,864 | B2 * | 10/2005 | Moreno ..... | A43C 7/02 24/306 |
| 7,237,347 | B2 * | 7/2007 | Tobias ..... | A43B 3/0078 36/112 |

(Continued)

*Primary Examiner* — Jila M Mohandesi

(74) *Attorney, Agent, or Firm* — Braun IP Law, LLC; Jeanette M. Braun

(57) ABSTRACT

An attachment combination for positioning an accessory along an elongate structure such as a shoe lace a shoe strap, arm or finger where the accessory has a loop attached to the accessory that at least in part holds the accessory to the elongate structure. In one form the accessory has a closed loop held inside a releasable clasp that has an open position for receiving the closed loop and the elongate structure and a closed position that holds the elongate structure and the closed loop together in a pocket formed by the releasable clap. The releasable clasp is a flexible strap having joinable sections that when spaced apart allow the strap to receive both the loop band and the elongate structure and when joined together surround the elongate structure and hold the loop band together with the elongate structure. The joinable sections may be the hook and loop portions of a hook and loop type strap. In another form the releasable clasp may be attached directly to the accessory.

12 Claims, 11 Drawing Sheets

(56) References Cited

U.S. PATENT DOCUMENTS

| | | | | |
|---|---|---|---|---|
| 8,397,357 | B1 * | 3/2013 | Madey | A43C 7/04<br>24/712.3 |
| 2004/0049948 | A1 * | 3/2004 | O'Shea | A43B 1/0054<br>36/70 R |
| 2004/0244162 | A1 * | 12/2004 | Schneider | A43D 999/00<br>24/712.3 |
| 2010/0313445 | A1 * | 12/2010 | Hochdoerffer | A43B 1/0054<br>36/50.1 |
| 2015/0181983 | A1 * | 7/2015 | Fox | A43B 23/25<br>132/200 |

* cited by examiner

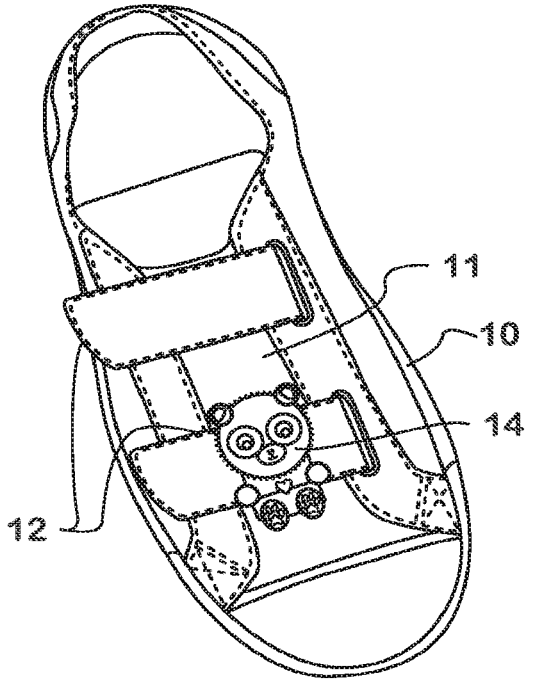
FIG. 1
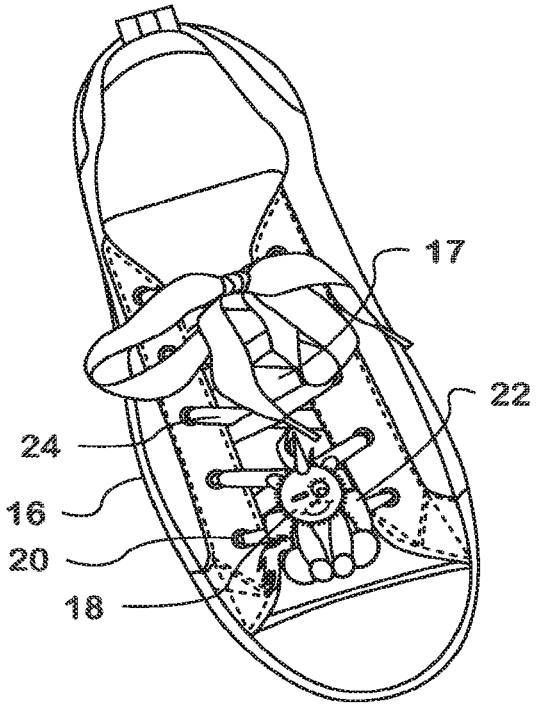
FIG. 2
FIG. 4
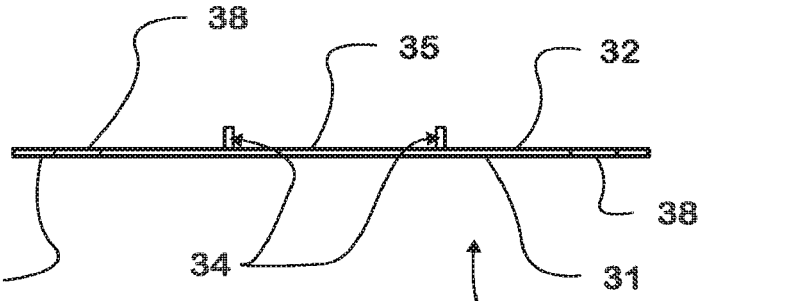
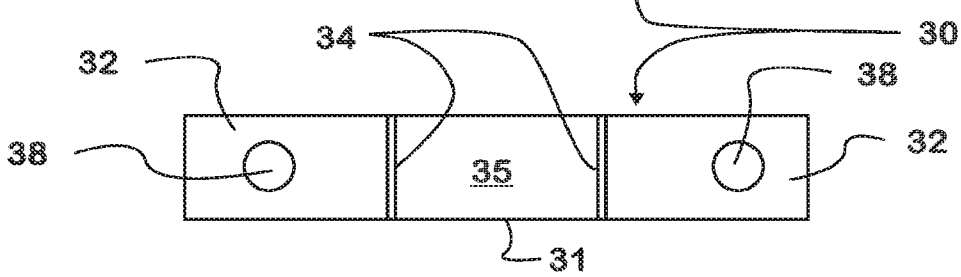
FIG. 3

FIG. 11
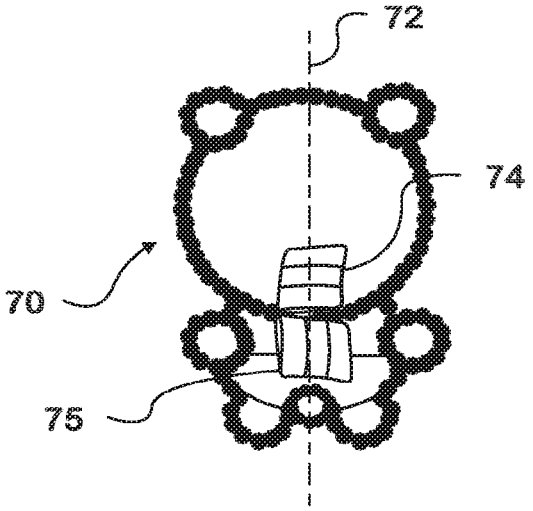
FIG. 12
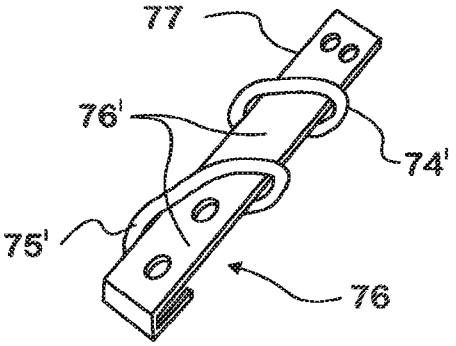
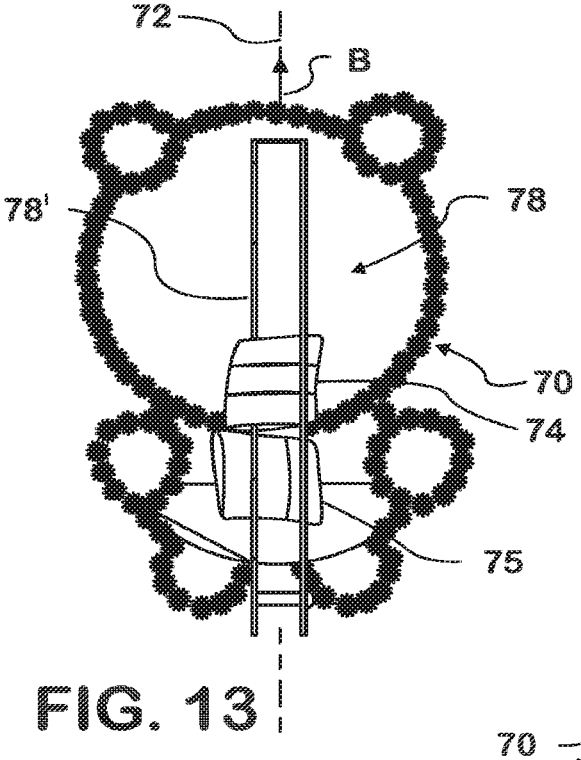
FIG. 13
FIG. 14
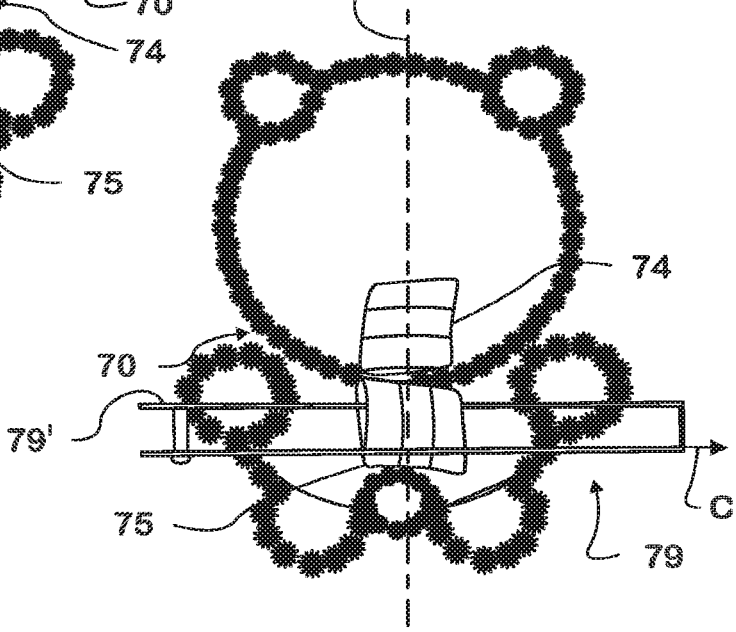

FIG. 19
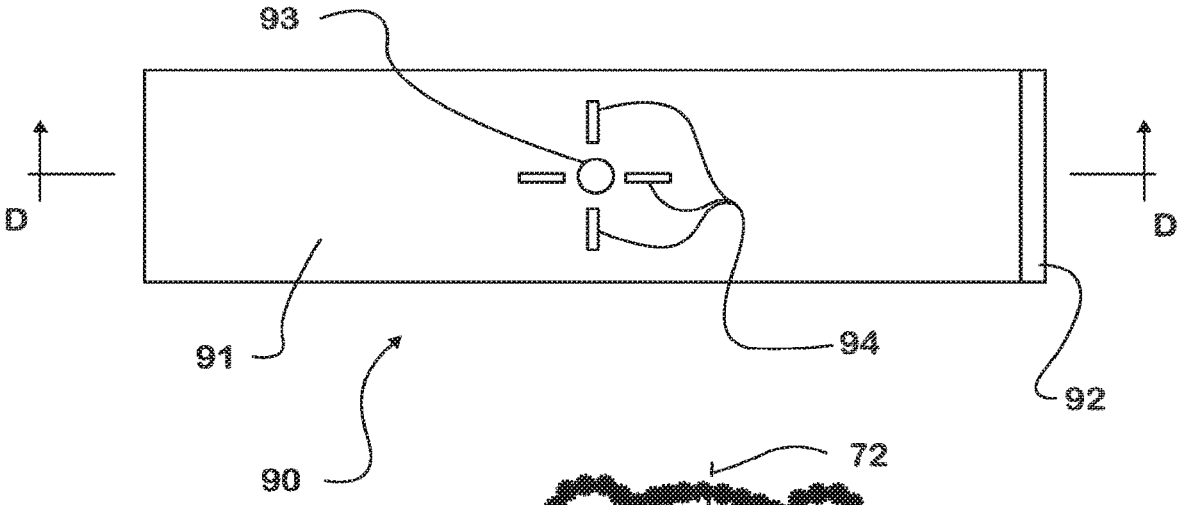
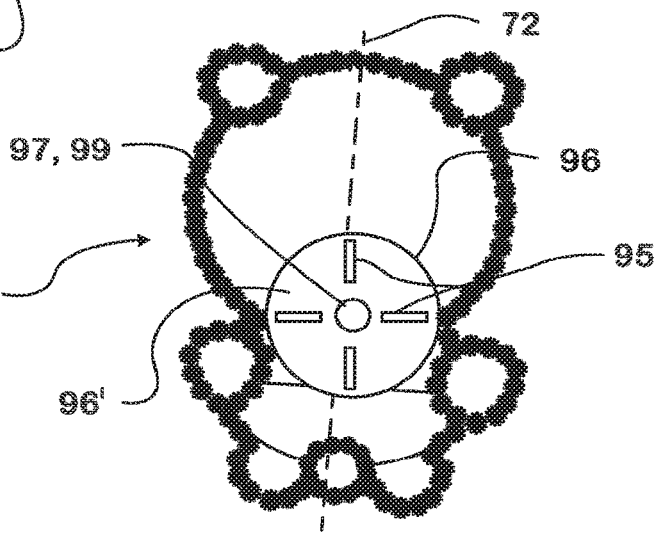
FIG. 20
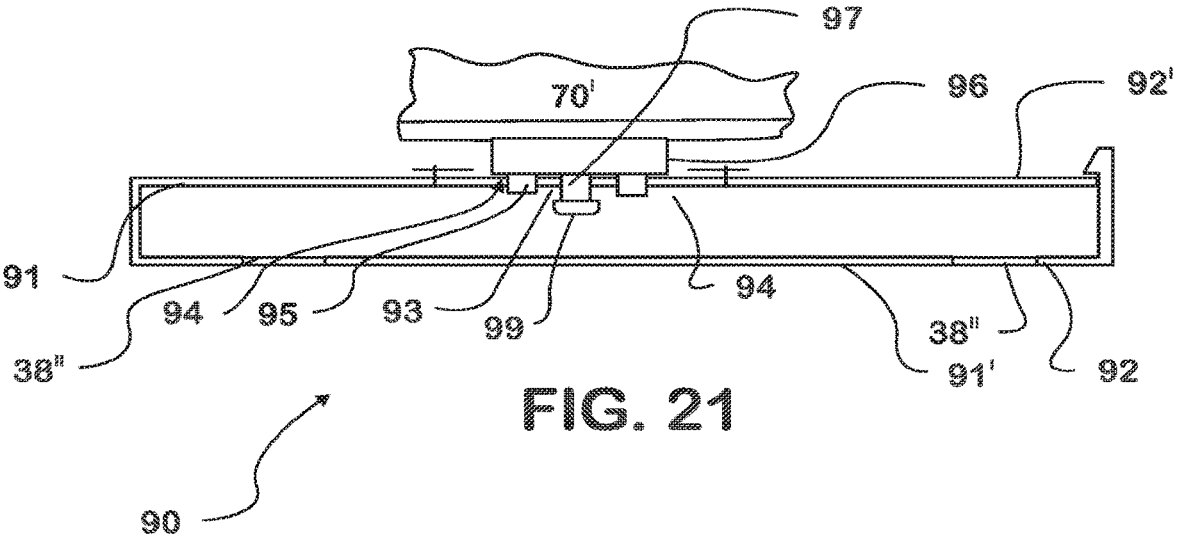
FIG. 21

100

ACCESSORY WITH TIGHT PULL STRAP FOR ENCIRCLING ATTACHMENT TO OTHER OBJECTS

REFERENCE TO RELATED APPLICATIONS

This application is a continuation-in-part of and claims priority from U.S. patent application "ACCESSORY WITH ATTACHMENT COMBINATION FOR POSITIONING ON ELONGATE STRUCTURE" having Ser. No. 15/889,448 filed Feb. 6, 2018, and now issued as U.S. Pat. No. 10,568,388 which is a continuation-in-part of and claims priority from U.S. patent application "SHOE ACCESSORIES AND BASE FOR MULTI-POSITION ATTACHMENT THEREOF" having Ser. No. 15/622,454, filed Jun. 14, 2017, now abandoned.

FIELD OF THE INVENTION

This invention relates generally to securing accessories to objects. More specifically the present invention relates to accessory items and the attachment thereof to structures about which a closable clasp may be secured using an attachment band in the form of a closed loop (hereinafter referred to as a "loop band") attached to the accessory where the clasp when open can receive both the structure and the loop band and when closed, holds the accessory to the structure via the loop band and the clasp. In particular aspects, the invention relates to the securing items to persons and clothing and is particularly useful for the attachment and detachment of accessory items to shoes.

BACKGROUND OF THE INVENTION

It is known that various accessories can be attached to living creatures and inanimate objects such as clothing to and, in particular, shoes using holders that secure such items for attachment and detachment. Such accessories include decorative items, ornamentation, and amusing objects. Many patents claim different arrangements for a holder and the article to secure these accessories to people, to clothes and to shoes.

U.S. Pat. No. 4,597,198 provides a structure for retaining decorative items such as decal on the vamp of a shoe with a holder that extends below flaps of the shoes and requires unlacing of the shoelaces from multiple eyelets and the re-lacing of the laces back through the eyelets and also through the holder.

The U.S. Pat. No. 6,640,467 shows a "Decorative Shoe Accessory" that uses a base located above the tongue of the shoe and that can be releasably attached to the vamp of the shoe by engagement with the shoe laces. The holder may releasably hold an ornamental figurine for interchange of such figures. The base holder cannot engage shoelaces for passage therethrough.

U.S. Pat. No. 7,779,519 is directed to an "Accessory for Shoelaces" that comprises a clamping device for retaining and encapsulating free ends of a shoe lace at the top of the shoe's vamp. The rear wall of the clamping device has a pair of openings positioned to receive the free ends of the shoelaces. Thus, the clamping device can only be used for shoelaces and only at the top of the shoe's vamp.

U.S. Pat. No. 7,237,347 shows many different decorative animal figures for attachment to the vamp of the shoe by its shoelaces or using hook and loop straps. Each depicted animal has a different holder incorporated into its body to retain the figure on shoelaces or via hook and loop straps in a different manner. To take advantage of the different positioning offered by the different attachment arrangement a different decorative animal figure is needed.

Thus, many different holders or attachment arrangements are available to secure accessories about the vamp of shoes. The numerous different holders and attachments permit the user to locate accessories in a wide variety of positions on or about a shoe's vamp. However, one needs many different holders and/or accessory attachments to vary the positioning of an accessory and attach the accessory to different types of shoes. Moreover, the most beneficial holder and accessory combination will accommodate many different sizes and styles of shoes with the same holder and accessory. Thus, the individual holders and accessory attachments of the prior art fail to provide a high degree of variation in the way each of them can secure an accessory in the vamp area of a shoe.

It is an object of this invention to provide a holder for attaching an accessory to an object having an extended portion long enough to provide the necessary length to fit a releasable clasp of this invention around the object. Another object of this invention is to provide a releasable clasp and loop combination for attaching an accessory to an object having an extended portion long enough to provide the necessary length to receive the releasable clasp of this invention. A further object of this invention is to provide a holder for attaching an accessory to an object such as a person, clothing or a shoe by engaging shoelaces or hook and loop straps in multiple ways to reliably secure an accessory to a shoe in a variety of positions.

It is a further object of this invention to provide an accessory that has attachments for securing the accessory to the vamp of a shoe in multiple positions by engaging the attachments with a holder.

It is yet another object of the invention to provide a combination of a holder and attachment on an accessory that provides a wide variety of possible positions in which the accessory may be securely attached about the vamp of a wide range of shoes.

SUMMARY OF THE INVENTION

This invention achieves these objects in one aspect by using an attachment band in the form of a loop attached to an accessory that is used in combination with a releasable clasp to position the accessory about an elongate structure. The elongate structure may be an article of clothing, a portion of the human body or a shoelace or strap of an article of footwear.

In another aspect this invention is an accessory and attachment combination that positions the accessory along an elongate structure using at least one loop band fixed to the accessory that provides a closed loop. A releasable clasp having unengaged and engaged positions receives the loop band and can be moved into engagement with the elongate structure when in an unengaged position and can engage the elongate structure to keep the loop band fixed thereto when in an engaged position.

In another aspect of the invention the attachment band comprises a flexible material and the releasable clasp is a flexible material that can be joined along its length to hold the attachment band in the form of a loop to the elongate structure. In a more specific aspect the releasable clasp is a flexible strap having joinable sections so that the strap can receive both the attachment band in the form of a loop and the elongate structure when the sections are not joined and so that the strap surrounds both the attachment band and the elongate structure in a closed pocket when the sections are joined together. Preferably the joinable sections are part of a hook and loop strap assembly (also known as Velcro® straps and hereinafter referred to as HK straps.)

In another aspect of this invention the attachment band comprises an HK strap attached directly to the accessory; the HK strap has an open position to receive a portion of an object for attachment of the accessory thereto. Suitable objects for attachment of the accessory via the HK strap will have a portion where the HK strap can encircle and trap the object by engagement of the strap's hook and loop surfaces. Typically, this portion takes the form of an elongate structure that the HK strap encircles when hook and loop surfaces located on opposite sides of the HK strap are brought into contact in a closed or looped strap position. In this aspect the HK strap may have a hook portion at one of its ends and loop portion at its opposite end for engagement with each other to close the strap band around the elongate structure with the strap secured to the article at least one location on the article and preferably with the strap secure to the article at approximately the mid-point of the strap. Alternately the invention may secure the strap to the article by at two point attachment that securing the strap to the article at two adjacent and opposite sides of the HK strap to allow insertion of one end of the strap between the strap and the article at the two point attachment such that an attachment end of the strap passes between the article and the strap so that the inner side of the attachment end can engage an outer portion of the strap to form an attachment that surrounds the elongate structure.

In another aspect, the accessory may have two loop bands in distinct positions and the releasable clasp may receive either loop band.

In a more specific aspect the invention uses a base to which an accessory can be attached on or about and elongate object.

In a more particular aspect the accessory may be attached to the vamp of a shoe that provides shoelaces or a strap as the elongate object, and the clasp is in the form of a base that provides an anchoring section that can be secured to straps or shoelaces by contact with the anchoring section and/or by passage of shoe laces through the anchoring section. The base may include at least one angularly adjustable attachment structure fixed to the base and/or the accessory.

In the above case the base may engage any form of elongate structure that serves as a gapping band to secure the accessory item to the vamp of the shoe. A gapping band is an elongate object or structure that can extends across another surface and may be spaced apart from it. Examples of a gapping bands, for purposes of this invention, include shoelaces, HK straps, and bands of decorative material located across or near the vamp of a shoe. An elongate structure or elongate object for purposes of this invention is any item having a length greater than its minimum diameter or width.

Accordingly, in another aspect of the invention the releasable clasp is a holder that can attach the accessory to an elongate structure in the form of a gapping band in a wide variety of places and to a wide variety of shoe configurations.

Another aspect of the invention is an accessory that has a principal axis, a front side, and a back side. At least one attachment structure is fixed to the back of the accessory and arranged for attachment to a base to provide at least a portion of a rotational element that fixes the accessory to a base in at least two rotational orientations of the principal axis relative to the orientation of the base. In another accessory-related aspect, the accessory has an attachment structure that includes at least two loop bands that may be in the form of cylindrical straps. Together with the base, that attachment structure provides the rotational element. In another aspect, the accessory has loop bands that may be in the form of cylindrical straps that are fixed to the accessory in a spaced apart relationship along the principal axis of the accessory, with one cylindrical strap providing an attachment band that extends parallel to the principal axis of the accessory and the other cylindrical strap providing a loop band that is transverse to the principal axis, with each loop band providing an opening that can receive an attachment section of a base, and the base is suitable for securing the accessory to the vamp of a shoe.

In yet another accessory-related aspect, the accessory has at least one loop band that may be in the form of cylindrical strap fixed thereto that passes through another loop banding to form a cylindrical strap that is fixed to the accessory wherein the angular position of the two cylindrical straps differs by at least 45°, and preferably 90° and each cylindrical strap provides an opening through which an attachment section of a base can extend.

In a more specific aspect, the invention uses an accessory, as described above, in combination with a base for attaching the accessory to a vamp area of a shoe wherein the shoe provides at least one gapping band in the form of straps, shoelaces or a decorative band, each of which extends across the vamp of the shoe. The base is comprised of an elongated plate having a length exceeding its broadest width, a thickness that does not exceed its average width, and at least two anchoring sections defined by a portion of the plate wherein at least one anchoring section is adapted to extend underneath at least one portion of a gapping band. The base includes an attachment section defined by a portion of the base. In another aspect of the invention, the plate defines at least two anchoring points spaced apart over its length and arranged to extend under two spaced apart HK straps. In another aspect, loop bands that may be in the form of cylindrical straps are fixed to the base in a spaced apart relationship along the longitudinal axis of the base with one cylindrical strap providing an opening that extends parallel to the longitudinal axis of the base, the other cylindrical strap providing an opening that extends transverse to the principal axis, and the base and the accessory have a clip with enough length to extend though the attachment bands.

In another aspect, the accessory has a longitudinally extended clip fixed thereto, the base has at least one attachment band in the form of cylindrical strap fixed thereto that passes through another loop band of a cylindrical strap that is fixed with respect to the base. The angular position of the two cylindrical straps differs by at least 45°, and preferably 90°, and each cylindrical strap provides an opening through which the clip can extend and engage the cylindrical straps for retention of the base.

In another aspect, the base includes a retaining bar that extends parallel to the plate and is fixed to the plate by a connecting section that joins the plate and the retaining bar. The plate, the retaining bar, and/or the connection section has sufficient resiliency to allow separation of the plate and bar to provide a temporary gap suitable to receive a gapping band. In further aspects, the connection section can comprise a strut that connects the plate to the bar. The strut provides, at least in part, resiliency to the plate and bar to provide the temporary gap. The strut is located at a common end or an intermediate section of the plate and bar. The connecting section can also comprise a hinge element at one end of the base.

In another aspect, the invention is a base for attaching an accessory on or about the vamp of a shoe wherein the accessory is of a type having a principal axis, a front side, and a back side, the shoe provides at least one gapping band in the form of straps, shoelaces or a decorative band each of which extends across the vamp of the shoe and the base can retain the accessory with its principal axis oriented in multiple angular positions to suit the gapping band arrangement of the shoe. In this aspect the base comprises an elongated plate having a length exceeding its broadest width, a thickness that does not exceed its average width, and at least two anchoring sections defined by a portion of the plate and spaced apart along the plate. Each anchoring section is adapted to extend underneath at least portion of a gapping band and each anchoring point defines a hole to receive the shoelace of a shoe at different sections of the shoelace.

The base also includes an attachment section defined by a portion of the base for retaining a decorative accessory thereon by engaging an attachment structure provided by the accessory. At least a portion of a rotational element fixes the accessory to the base in at least two rotational orientations of the principal axis relative to the base. The attachment section is preferably defined between the two anchoring sections.

BRIEF DESCRIPTION OF THE DRAWINGS

FIG. 1 is a depiction of a shoe with an HK strap having an accessory attached thereto using the base of this invention.

FIG. 2 depicts a lace-up shoe with an accessory attached thereto using the shoelaces and the base of this invention.

FIG. 3 shows a base arrangement using a single plate.

FIG. 4 shows a side view of the base of FIG. 3.

FIG. 11 shows an accessory in the form of a furry animal with two spaced apart loop bands in the form of cylindrical straps to provide different rotational position of the accessory.

FIG. 12. is an isometric view of a pair of loop bands in the form of straps that encircle the retaining bar.

FIG. 13 shows the accessory of FIG. 11 with a retaining bar of the base extending through one of the straps of FIG. 11.

FIG. 14 shows the accessory of FIG. 11 with a retaining bar of the base extending through a different strap of FIG. 11 than that shown in FIG. 13.

FIG. 19 shows a retaining bar that defines a lower portion of a pivot structure that provides a pivot section arrangement.

FIG. 20 shows the upper portion of the pivot structure fixed to an accessory and configured to engage the portion of the pivot section structure shown in FIG. 11.

FIG. 21 is a sectional view taken at section D-D of FIG. 19.

DETAILED DESCRIPTION OF THE INVENTION

Figure 5:
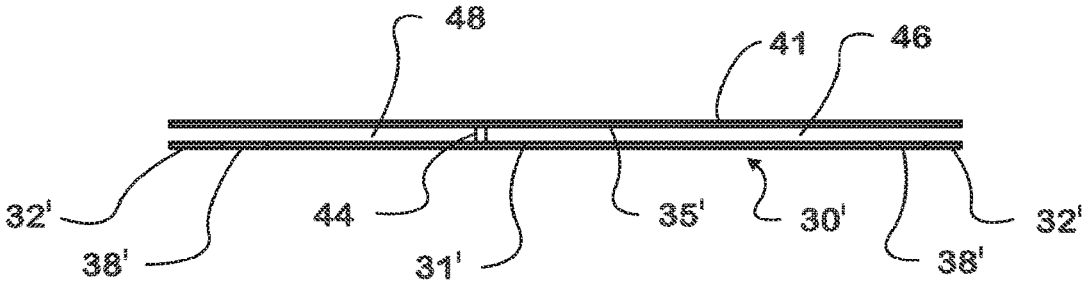
FIG. 5 shows a side view of a base with a retaining bar and an intermediate strut joining a plate and the retaining bar.

The invention is best understood by reference to the figures. Description of the invention in the context of the Figures is not intended to limit the configurations and applications of the invention to the specific figures depicted herein.

A typical child's sneaker or athletic shoe 10 having a gapping band in the form of HK straps 12 is shown in FIG. 1. An accessory in the form of a toy animal 14 is attached to one of the straps 12 by a base (not visible) that engages the strap and the accessory in a manner hereinafter described in more detail. FIG. 1 shows the accessory attached at the vamp 11 of shoe 10 by only one HK strap 12. However, the base may be extended to engage more than one HK strap 12

(as shown below) especially in the case where the base is used to secure large accessories. The base has a vertical orientation wherein it extends in a direction transverse to the length of vamp 11.

FIG. 2 shows an alternate usage of a base 22 of FIG. 1 to secure an accessory in the form of a toy 18, that is different from that shown in FIG. 1, to a shoe 16 having a gapping band in the form of shoelace 24 instead of HK straps. The base 22 is fixed to shoe 16 by having shoelace 24 thread through holes in the base (as hereinafter shown). As opposed to the base having a vertical orientation as in FIG. 1, base 22 in FIG. 2 has a horizontal orientation and the base is transverse to vamp 17 of shoe 16.

In FIG. 2 base 22 has shoelace 24 threaded through it at the location where the shoelace passes through the lowest set of eyelets 20 (i.e. closest to the toe of the shoe.) Base 22 can engage shoelace 24 by threading through one or more eyelets at any eyelet location. Moreover, base 22 can thread through eyelets on the same side of vamp 17 to give the base a vertical orientation and place the accessory to one side of the vamp of the shoe.

It is also possible to have the base when in the vertical orientation of FIG. 1 to engage a decorative band that extends transverse to vamp of shoe or to have the base, when in the horizontal orientation of FIG. 2, engage a decorative band that extends in a direction substantially parallel to vamp of shoe. Certain loafer style shoes have a transversely extending strap secured across the top vamp portion of the shoe. In some cases, particularly the leather band at the top of penny loafers, a portion of the base may slide under the decorative band for securing the base thereto.

A very simple form of the invention is shown in FIGS. 3 and 4 where like numbers refer to like elements. A base 30 principally comprising an elongated plate 31 having a length greater than its width and a thickness less than the widest width of plate 31. Plate 31 defines at least one anchoring section 32 that can slide underneath an HK strap, a decorative strap, or shoelaces. Plate 31 may define the anchoring section 32 at any location over its length of plate 31 and may provide more than one anchoring section. The anchoring section will also define at least one hole 38 for threading a shoelace therethrough. Preferably plate 31 has an anchoring section 32 at each end with a hole 38 defined at each anchoring section 32. Plate 31 also provides an attachment section 35 about an accessory that is fixed to attach the accessory to plate 31. Optional abutments 34 can extend upwardly from plate 31 to keep the accessory located, preferably centered, in the attachment section.

Base 30 consists of a material with enough rigidity to engage a gapping band and keep the accessory in a relatively fixed position on or about the vamp of a shoe. Preferred materials are flexible materials that provide semi-rigid support. Metals and plastics are particularly suitable materials. Plastics are particularly preferred for their ability to be molded and its ease of forming with other components of different base arrangements as hereinafter described. Many different polymers will provide suitable plastics including polyethylene terephthalate, high and low-density polyethylene, polypropylene, polystyrene, and polyamides.

Moreover, the invention is most applicable for attachment to shoes although it could be used to attach accessories to other articles of clothing, especially belts, necklaces, head bands, and other articles of clothing that can provide a relatively narrow band that the base can engage. The invention can also be used for attachment of accessories to the human body.

In FIG. 5, a retaining bar 41 is fixed to plate 31' of a base 30'. The base arrangement depicted by FIG. 5 shows a side view of base 30'. A strut 44 secures bar 41 to plate 31' and together define a gap 48 to the left of the strut 44 and gap 46 to the right of strut 44. The base 30' may have anchoring sections 32' at opposite ends of plate 31' and each anchoring section may define hole 38' for threading a shoelace there through. Either or both of gaps 46 and 48 may receive a gapping band at single or multiple locations along attachment section(s) 35' that are located along plate 31'. Gaps 46 and/or gap 48 may provide a gap that is smaller than the width of the gapping band so that bar 41 together with plate 31' may squeeze the gapping band to keep an accessory in a fixed location relative to the base 30'.

Bar 41 may have the same or a different width than plate 31' and may have the same or a different length than plate 31'. Where the width of plate 31 and bar 41 differ, preferably bar 41 will have a smaller width than plate 31' so that a shoelace threaded through holes 38' may extend between holes 38' over the top of plate 31'. Another alternative for accommodating a shoelace that passes over plate 31' is to reduce the length of strut 44 relative to the width of plate 31' and/or bar 41.

Figure 6:
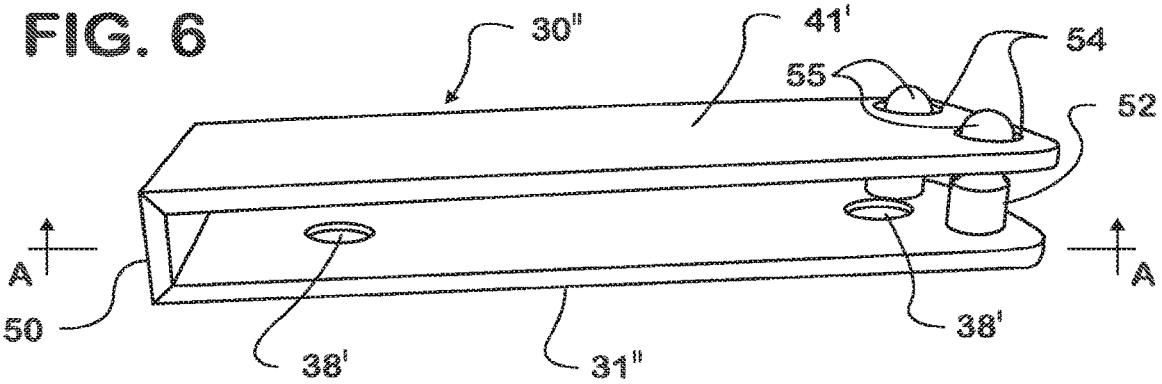
FIG. 6 provides an isometric view of a base with a retaining bar and an end strut joining a plate and the retaining bar.
Figure 7:
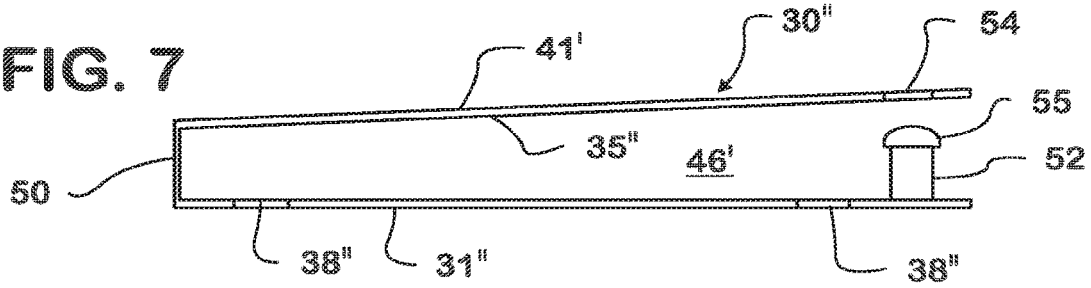
FIG. 7 is a sectional side view of the base of FIG. 6 taken at A-A with the retaining bar in an open position.

An isometric representation of another arrangement for the base of this invention appears in FIG. 6 along with a sectional view depicted by FIG. 7 and taken at section A-A of FIG. 6. FIGS. 6 and 7 show a base 30" having a plate 31" flexibly connected to a retaining bar 41' by a strut in the form of a hinge 50. The bar 41' has a closed position as shown in FIG. 6 and an open position as shown in FIG. 7. When in the closed position, a pair of posts 52 that extend upwardly from plate 31" engage bar 41' by extending through holes 54 defined by bar 41'. An enlarged head 55 at the top of each post 52 is sized relative to the side of holes 54 to snap through the holes 54 and to hold bar 41' in the closed position. The heads 55 are sized so that pulling bar 41' upward will urge heads 55 through holes 54 and move base 30" to an open position as shown in FIG. 7. Putting the base in the open position allows insertion of a gapping band into gap 46' that has a gap size defined by the width of hinge 50 between plate 31" and retaining bar 41' at one end and by the length of posts 52 below head 55 at the other end. Posts 52 and heads 55 provide the plate 30" with a lower locking structure and holes 54 provide bar 41' with an upper locking structure.

Figure 8:
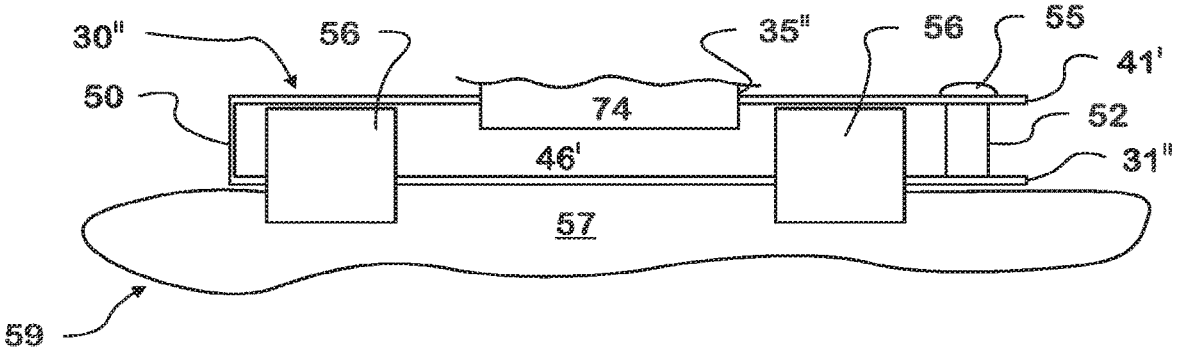
FIG. 8 is a side view of the base of FIG. 6 with retaining bar in a closed position and secured to two HK straps.

FIG. 8 shows the plate 31" of base 30" inserted between two gapping bands in the form of HK straps 56 and a vamp section 57 of a shoe 59. In this arrangement, bar 41' preferably presses against the top of two gapping bands in the form of HK straps 56. Bar 41' and together with plate 31" keeps base 30" fixed with respect to shoe 59. Pressure from plate 31" and bar 41' can retain straps 56 in a desired location with respect to vamp section 57. A portion of an attachment structure in the form of a cylindrical strap, provides an attachment band 74" attached to the accessory that is slipped over the attachment section 35" of base 30".

Figures 9, 10:
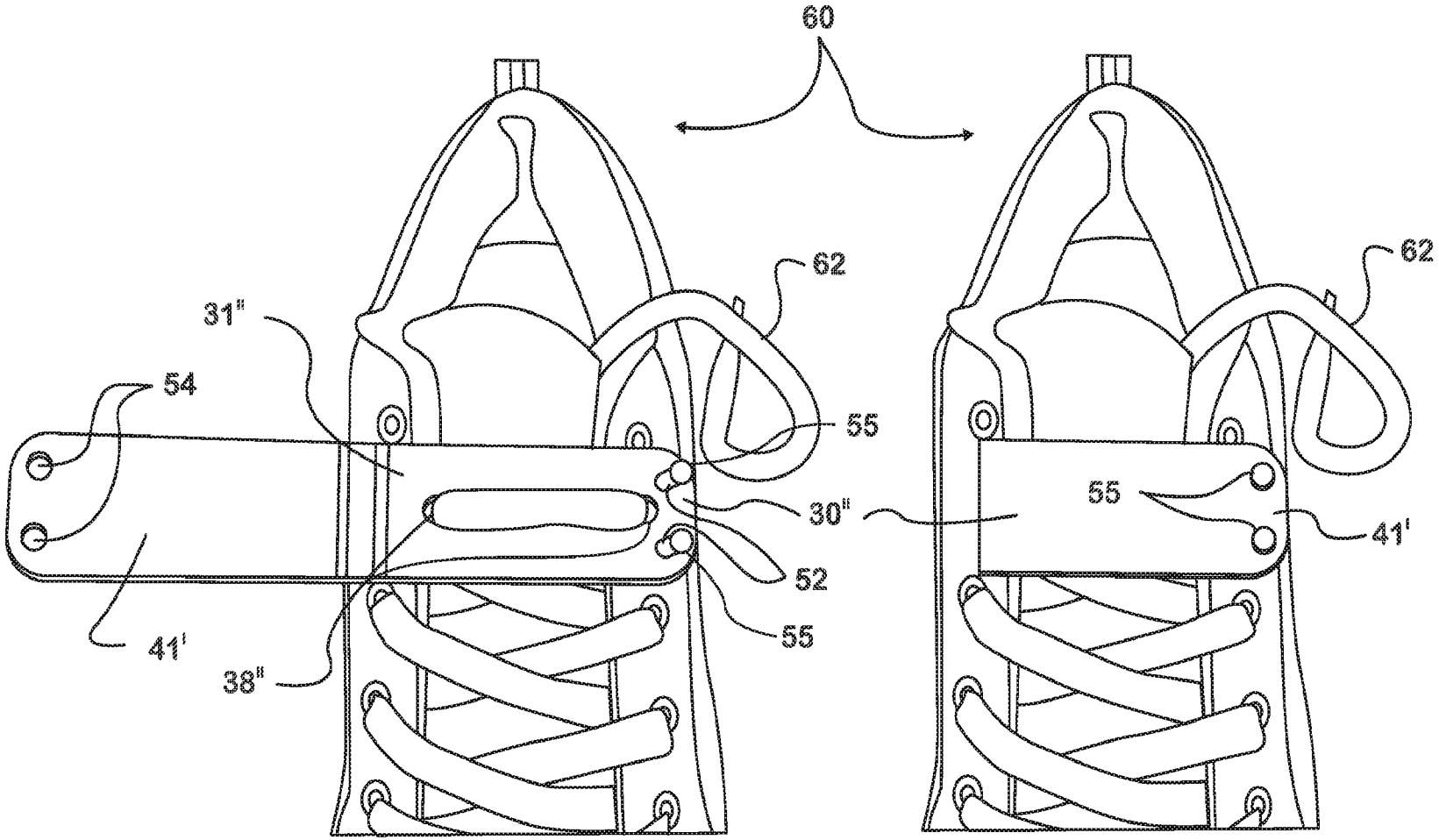
FIG. 9 depicts the retaining bar of FIG. 6 with the base secured to a shoe by its laces and with the retaining bar in an open position.
FIG. 10 depicts the shoe and base of FIG. 9 with the retaining bar in a closed position.

FIGS. 9 and 10 show the base 30" of FIGS. 6-8 (with like numbers in FIGS. 6-10 referring to like elements) in open and closed positions at the top of a shoe 60 having a shoelace 62. Shoelace 62 threads through holes 38" and across plate 31" of base 30". FIG. 9 shows retaining bar 41' swung away from plate 31" for threading lace 62 through holes 38". FIG. 10 shows bar 41' positioned on top of lace 62 and plate 31" with plate 41' secured in the closed position by engagement of heads 55 of posts 52 with holes 54.

Figure 22:
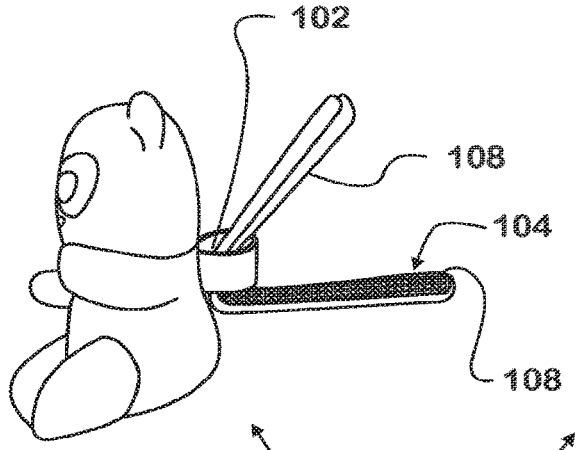
FIGS. 22 through 24 show an accessory in the form of a toy bear having a closed loop attached to its back and an attachment strap in multiple open positions and a closed position.
Figure 23:
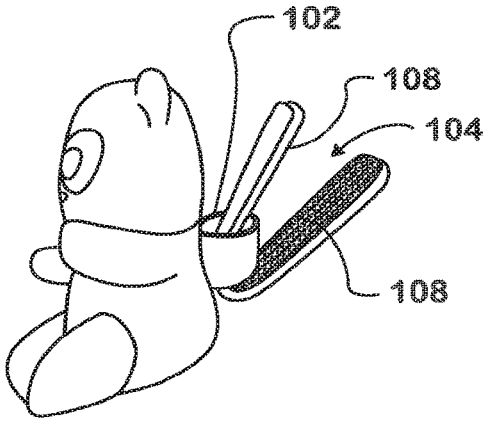
Figure 24:
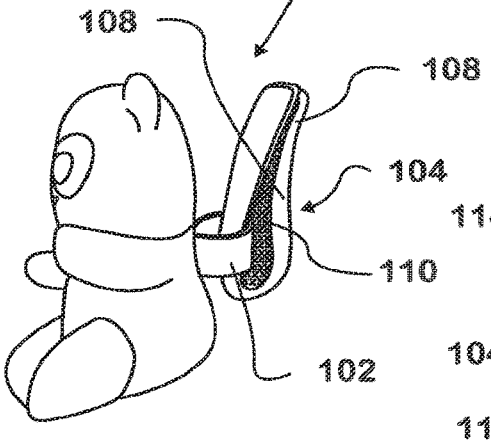

FIG. 22 through 24 show an accessory 100 in the shape of a small bear having a single loop band 102 fixed to its back to provide a closed loop. A releasable clasp in the form of strap 104 extends through the band 102. The releasable clasp has a first joinable section 106 at one end of strap 104 that can be joined with a second joinable section 108 and the other end of strap 104. When joinable sections 106 and 108 are joined together strap 104 forms a closed pocket 110 that surrounds the band 102.

FIGS. 22 through 24 show the releasable clasp in the form of strap 104 in various position used when engaging the band 102. FIG. 22 shows strap 104 in a fully open position. FIG. 23 shows strap 104 in a partially open position. FIG. 24 shows strap 104 in a fully closed position such that the strap surrounds the band 102 and retains it in closed pocket 110.

Figure 25:
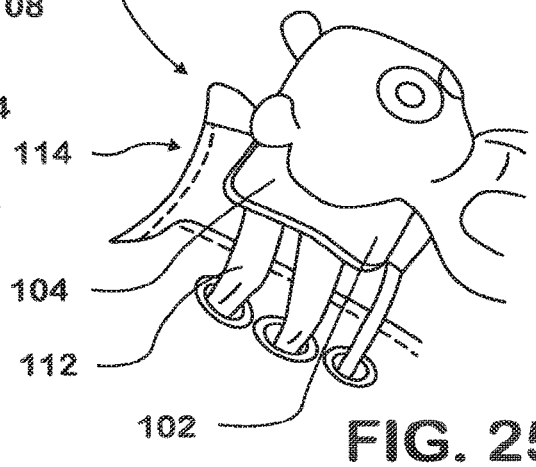
FIG. 25 shows the toy bear of FIGS. 22 to 24 attached to the vamp of a shoe.

FIG. 25 shows accessory 100 positioned on the vamp 114 of a shoe using several of the shoelace sections 112 as the elongate structure. In this configuration the joinable end of the strap 104 hold both shoelaces 112 and loop band 102 in the pocket 110 (as shown in FIG. 24.)

Figure 26:
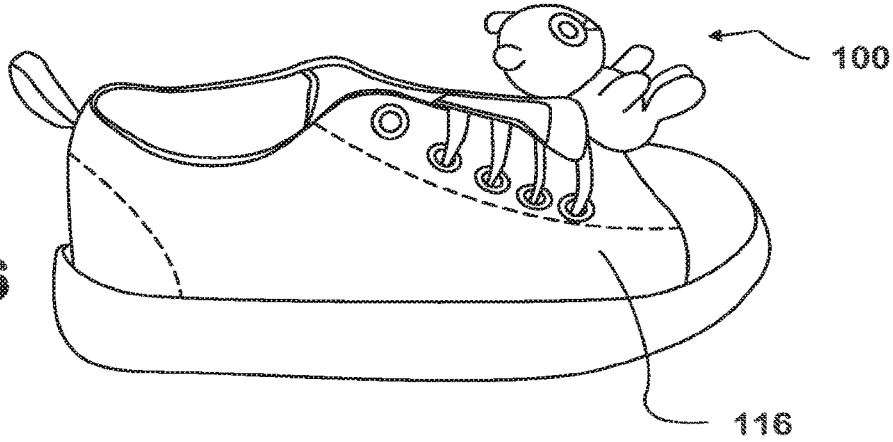
FIG. 26 shows an entire shoe with the toy bear of FIGS. 22 to 25 attached to the vamp of the shoe.

FIG. 26 shows the accessory 100 positioned on a shoe 116 in accordance with the description of FIGS. 22-25. FIG. 26 thereby fully illustrates one form of a releasable clasp positioning an accessory on a shoe in accordance with this invention.

Figure 27:
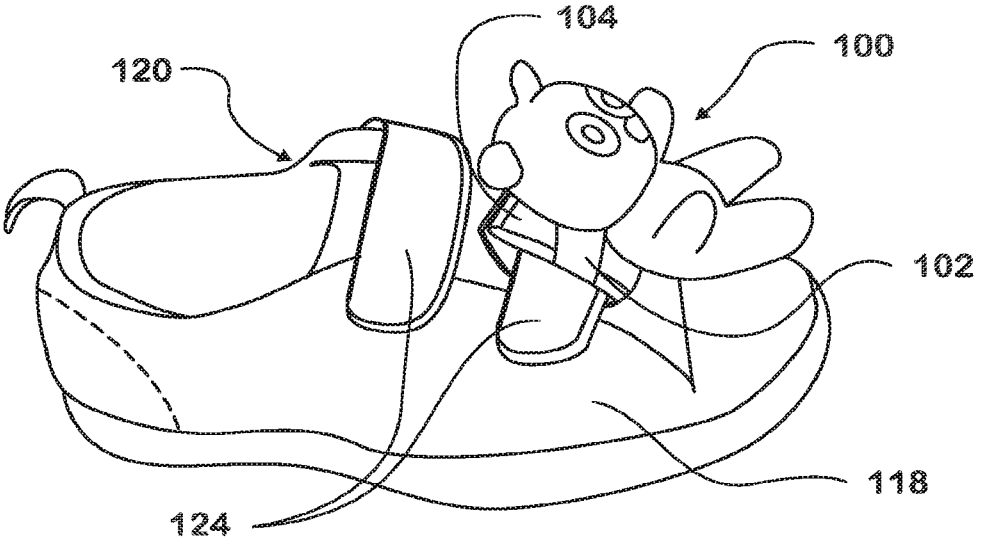
FIG. 27 shows a shoe having HK straps and a toy bear attached to one of the shoe's HK straps by the attachment strap of FIGS. 22 to 24 attached to the vamp of the shoe.

FIG. 27 shows the attachment of an accessory 100' positioned on the vamp 120 of a shoe 118 that has HK shoe straps 124 that are used to secure the shoe on a foot and extend across a vamp 120. A releasable clasp in the form of a strap 104' retains an attachment band 102' and one of the HK shoe straps 124 in the pocket of the strap 104' that is formed by joining the end of strap 104' in the manner previously described.

Figure 28:
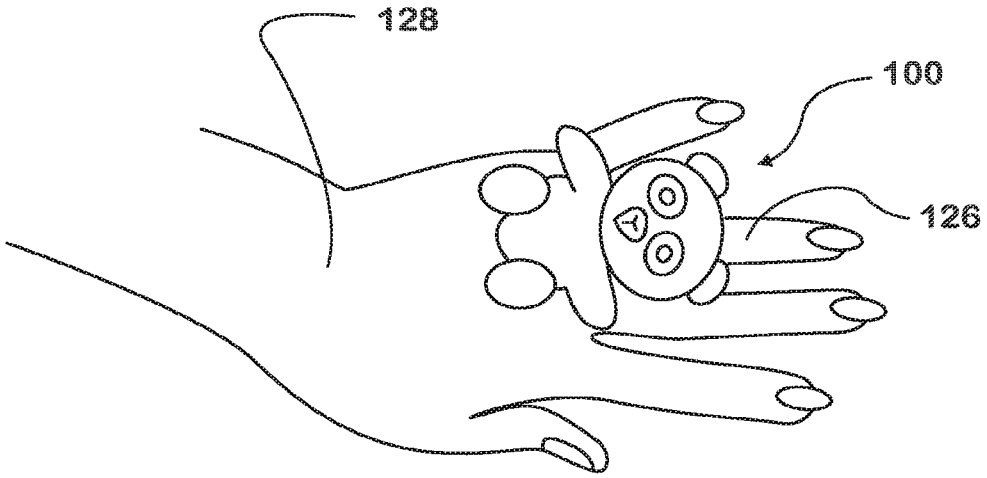
FIG. 28 shows a toy bear attached to a finger using the attachment strap of FIGS. 22 to 24.

FIG. 28 shows an accessory 100" positioned on the ring finger 126 of a human hand 128. Preferably accessory 100' is positioned by a releasable clasp of the type illustrated by FIGS. 22-24, In this depiction of the invention the ring finger 126 provides the elongate structure.

FIG. 11 shows an accessory as a creature in the form of a furry animal 70 (e.g. a miniature furry bear) having a vertically oriented principal axis 72. Like numbers in FIGS. 11, 12, and 13 describe like elements. A cylindrical strap in the form of a loop band 74 provides an attachment structure and is fixed to the creature 70 to provide a hole that opens in a direction perpendicular to principal axis 72. A cylindrical strap in the form of an attachment band in the form of a loop 75 is fixed to the creature 70 and provides a hole that opens in a direction parallel to principal axis 72.

FIG. 13 shows the furry animal 70 secured to a base 78 of the type generally shown in FIGS. 6 and 8. A retaining bar 78' is inserted into and passes through loop band 74. In this manner loop band 74 provides an attachment structure. The use of retaining bar 78' with loop band 74 orients base 78 with its long dimension extending in direction B and parallel to principle axis 72. In the arrangement depicted by FIG. 13, the relationship between loop band 74 and the retaining bar 78' orients the animal 70 in a generally vertical position with respect to principal axis 72. This positioning of base 78 and use of loop band 74 most often occurs when attaching base 78 to an HK strap or to HK straps.

FIG. 14 shows animal 70 secured to a base 79 with a retaining bar 79' that is of the type generally shown in FIGS. 6 and 8. The retaining bar 79' is inserted into and passes through loop band 75. In this manner, loop band 75 provides an alternate attachment structure to that used by animal 70 in FIG. 13. The use of retaining bar 79' with loop band 75 orients base 79 with its long dimension extending in direction C and perpendicular to principle axis 72. This positioning of base 79 and use of loop band 75 keeps animal 70 in a vertical orientation typically when attaching base 79 to a shoelace.

FIG. 12 shows a base 76 where the attachment section 76' incorporates loop bands 74' and 75', that may be in the form of cylindrical straps. The band 74' and band 75' are fixed to a retaining bar 77 of base 76. The bands and the openings that they form provide a portion of a rotational element that allows change in the angular positioning of animal 70.

Figure 15:
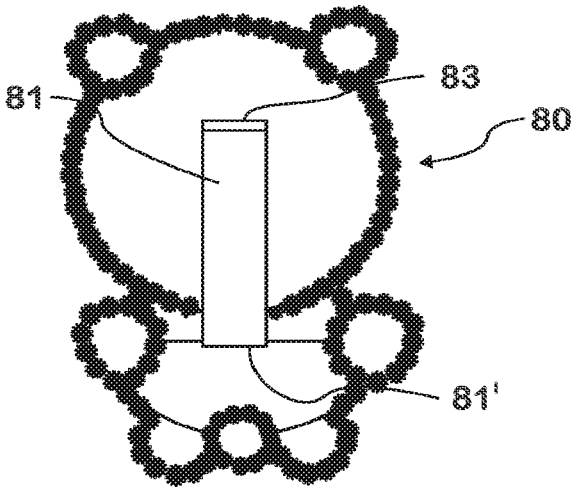
FIG. 15 shows an accessory of the same general type as that shown in FIG. 11 with the straps replaced by a clip having a longitudinal orientation in line with the principal axis of the accessory.

FIG. 15 shows an accessory in the form of a furry animal 80 of the type generally shown in FIGS. 11, 13 and 14. Animal 80 has an attachment structure in the form of a longitudinally extended clip 81. Clip 81 is secured to the animal 80 at an upper end 83 by an appropriate fastener such as stitching, stapling, bonding or any other method that will keep clip 81 secured to animal 80. A bottom end 81' of clip may be displaced from the animal 80 by an amount sufficient to slide an attachment band or cylindrical strap around it.

Clip 81 may work in conjunction with base 76 of FIG. 12. Clip 81 can be inserted and passed through either of loop band 74' and or loop band 75' to orient animal 80 either perpendicular to or parallel to the base 76.

Figure 17:
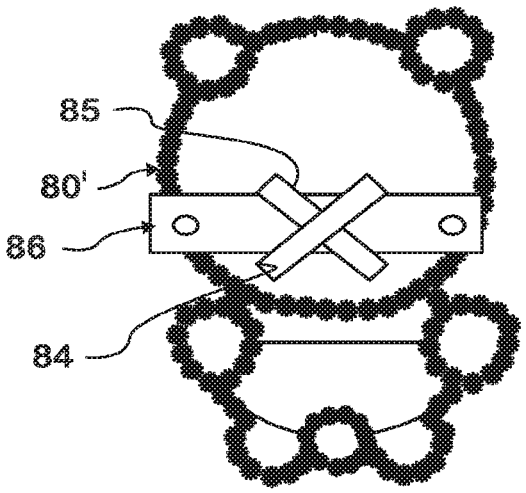
FIG. 17 shows the accessory of FIG. 16 with the straps surrounding the plate of a base.
Figure 16:
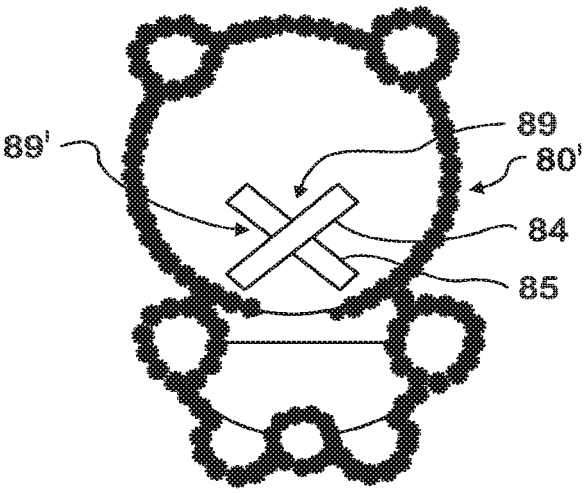
FIG. 16 shows an accessory of the same general type as that shown in FIG. 11 with the spaced apart straps replaced by intersecting straps.
Figure 18:
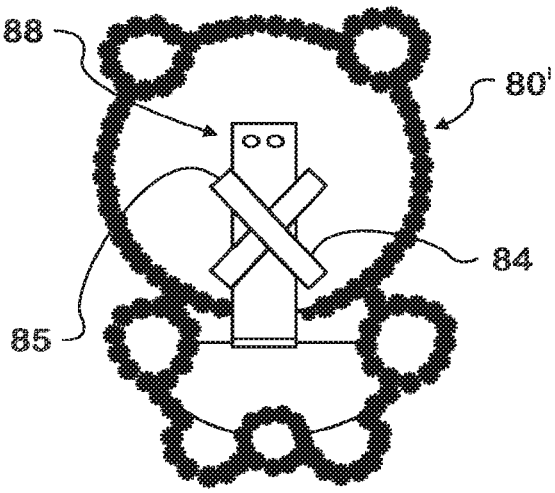
FIG. 18 shows the accessory of FIG. 16 with straps surrounding the retaining bar of a base.

FIG. 16 shows a support structure comprising a pair of loop bands 84 and 85. Loop band 85 passes through loop band 84 and both loop bands are secured to a furry animal 80'. Loop bands 84 and loop band 85 are configured for the insertion of the base of this invention through both loop bands simultaneously to retain animal 80' in a base in the manner as shown in FIGS. 17 and 18. The crossing arrangement of loop bands 84 and 85 allow an insertion of a tab 86 or 88 in the form of a clip, bar, or plate to be inserted through both loop bands from either vertex opening 89 or 89' and through both loop bands 84 and 85. Loop bands 84 and 85 may be secured in any of the previously described ways and in any crossing arrangement that provides a suitable crossing pattern that meets the requirements as described herein. Thus, while vertex angles of 90° are used most often, the angle of vertex 89 and 89' may vary from each other such that one has an acute angle and the other has an obtuse angle. The acute angle for either vertex 89 or 89' is usually no less than 45° and preferably no less than 60°. In FIGS. 11 through 18, the bands are shown in positions that orient the base or accessory associated therewith in a first position or an alternate position that is at a right angle to the first position and in alignment along a parallel or perpendicular direction with respect to the vamp of a shoe. Any of the various attachment structures and attachment sections may be oriented in a way that positions an accessory at odd angles with respect to the parallel or perpendicular axis of the shoe's vamp.

There are also other base configurations that may provide variable angular orientations of the accessory that remain firmly fixed until repositioned. Some of such arrangements permit adjustment of the accessories angular orientation without removal of the accessory or the base from the shoe.

FIGS. 19-21 show one possible form of base arranged in accordance with this invention that enables adjustment of the angular position of the accessory relative to the base and with respect to the shoe. The person wearing the shoe may make this angular adjustment without removal of the base or accessory from the shoe. Furthermore, this arrangement will keep the accessory in a relatively fixed angular orientation until an adjustment force from the wearer is applied to change the relative orientation.

Turning then to FIGS. 19-21, a base 90 has a retaining bar 91 that defines a central pivot post hole 93 and a set of positioning slots 94 defined in and by bar 91. FIG. 19 shows slots 94 extending in a radial pattern from pivot hole 93 and the slots have the same sector angles between the slots. FIGS. 20 and 21 show an arrangement of protruding lugs 95 that depend from the bottom surface 96' of a pivot disc 96. Any of the previously described methods can be used to secure pivot disc 96 to animal 70'. The arrangement of lugs 95 correspond with the slots 94 for engagement therewith and provide upper and lower stop structures.

Pivot disc 96 has a disc post 97 at its center that is sized for insertion into pivot post hole 93 to provide relative rotation between the pivot disc 96 and the bar 91. An enlarged head 99 at the end of disc post 97 is sized to retain disc post 97 in pivot hole 93 and can be sized for removal of the pivot disc by pulling the accessory, i.e. animal 70', with pivot disc 96 attached thereto away from the bar 91 with a predetermined force.

One can adjust the angular position of the animal 70' by pulling on the animal, and pivot disc 96 along with it, away from the base 90 and bar 91 until the pivot disc 96 can rotate the accessory to the desired position relative to base 90. The relative force necessary to displace pivot disc 96 for rotation is preferably less than that required to displace pivot disc post 97 from pivot hole 93. Alternatively, enlarged head 99 may be sized such that angular positioning of pivot disc 96 is adjusted by removal and reinsertion of pivot post 97 into pivot hole 93.

Pivot disc 96 may be removably secured to animal 70' for removal from animal 70' and attachment to a different accessory. With such an arrangement, various accessories can be used with the same pivot disc that is designed for removal from animal 70' and attachment to another accessory. Alternatively, a user of the accessory and base combination may have multiple accessories that all have a pivot disc attached thereto.

In FIGS. 19-21 the configuration of base 90 also show an alternate arrangement for securing and releasing a bar 91 to and from a plate 91' using a hold down clip 92 positioned at the side of base 90. Hold down clip 92 provides plate 91' with an outer locking section. Hold down clip 92 has a displaceable latch 92' that can be urged away from the end of bar 91 to release bar 91 from a closed position with respect to plate 91'.

The end of bar 91 proximate to the clip 92 provides the bar with an upper locking section. Bar 91 may be pushed toward plate 91' and past latch 92' to put base 90 back into a closed position.

Figure 29:
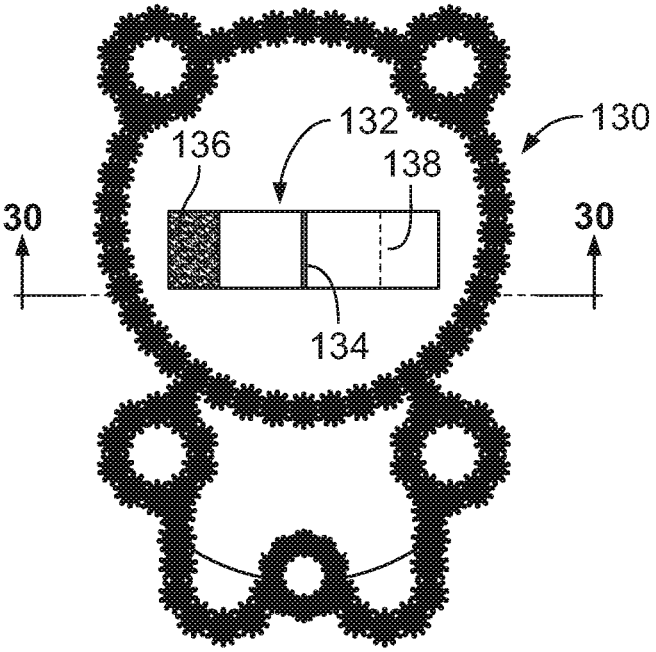
FIG. 29 shows a toy bear with an HK strap in an open position attached to the back of the bear's head.
Figure 32:
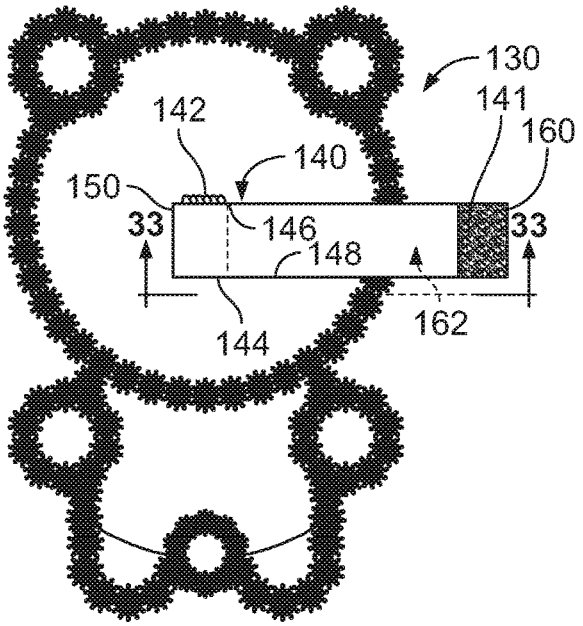
FIG. 32 shows and alternate arrangement for affixing an HK strap to the back of a toys bear's head and that shows the HK strap in an open position.
Figure 34:
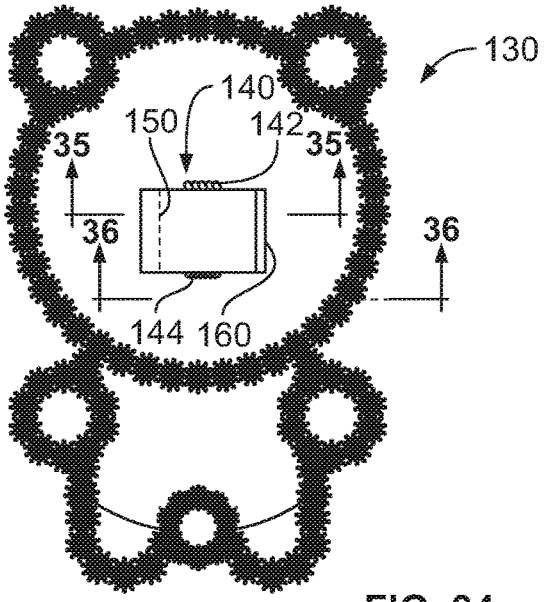
FIG. 34 shows the HK strap of FIGS. 32 and 33 with one end of the strap attached to another portion of the strap in a closed position for surrounding an elongate structure.

The arrangement of FIG. 29 shows an HK strap 132 affixed to the back of the head of a toy bear 130 at a tying section 134. The illustration of the article attached to HK strap 132 as bear 130 is only for exemplary purposes and does not limit the type of article that may be attached to the elongate structure via HK strap 132. Tying section 134 will securely affix the strap by use of mechanical attachment or adhesives. Preferably the strap is sewn to the bear 130 along a line of stitching that extends transverse to the strap (as shown in FIG. 29) or one or more short lines of parallel stitching (as shown in FIGS. 32 and 34). One end of strap 132 contains the hook portion 136 of a hook and loop arrangement and all or a portion of the remaining strap contains a loop surface 138 on the side of the strap opposite hook portion 136. In many arrangements the loop portion will extend over at least half of the length of the strap. Tying section 134 may secure the strap anywhere along the strap provided the location of tying section 134 leaves enough exposed hook and loop portions for engagement thereof.

The material of HK strap 132 may comprise inelastic materials but will preferably comprise elastic materials. Elastic materials can provide more variation in the circumferential tension provided by HK strap 132 when it is in the closed position and surrounds elongate structure 140. Increasing the circumferential tension provided by HK strap 132 can hold strap 132 more securely around elongate structure and any article to which HK strap 132 is attached and minimize movement between of the article, in this case bear 130, relative to the elongate structure. An elastic material can also increase the comfort of wearing HK strap 132 when the elongate structure comprises something such as a human finger.

Figure 30:
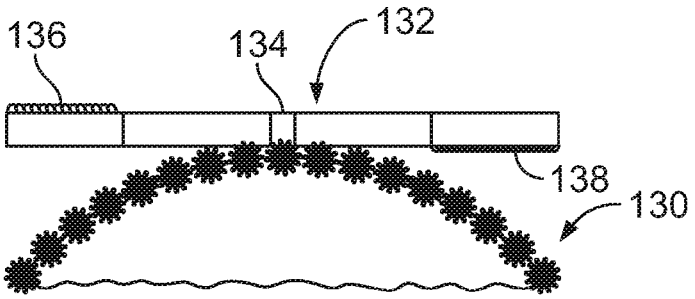
FIG. 30 is a view of the HK strap of FIG. 29 and a partial view of the back of the bear's head taken along lines E-E of FIG. 29.
Figure 31:
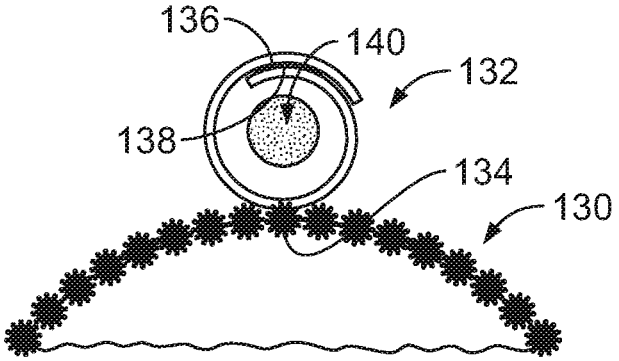
FIG. 31 shows the HK strap of FIGS. 29 and 30 with the ends attached in a closed position for surrounding an elongate structure.

FIG. 30 and FIG. 31 respectively show strap 132 in open and closed positions. FIG. 30 more effectively shows the positioning of hook portion 136 and loop portion 138 on HK strap 132 and where HK strap 132 is fixed to bear 130 at tying section 134. FIG. 31 shows hook portion 136 engaged with loop portion 138 to establish a closed position for HK strap 132 that surrounds an elongate structure 140.

FIG. 32 shows a variation in the positioning and attachment, relative to FIG. 29, of an HK strap 142 to bear 130. The arrangement of FIG. 32 locates a majority of HK strap 140 to one side of the bear's head. HK strap 140 is secured to the bear 130 via a first tying section 142 that extends a short distance along an edge 146 of HK strap and at a tying section 144 via a second tying section 144 that extends a short distance along an edge 148 of HK strap 140. Tying section 142 and 144 are immediately across from each other opposite sides of HK strap 140. Tying points 142 and 144 having the same spacing or a similar spacing from an end 150 and/or an end 160 of the HK strap 140. Thus the 140 will have a short segment that will extend at least over the length of the tying section and preferably a short distance beyond the tying sections and a long segment that extends to the right of the tying sections in the depiction given by FIG. 32. As more full depicted FIGS. 36 and 37 and explained in conjunction therewith, this attachment arrangement allows end 160 to slide below the respective portions of HK strap 140 and bear 130 located between tying section 142 and 144.

Figure 33:
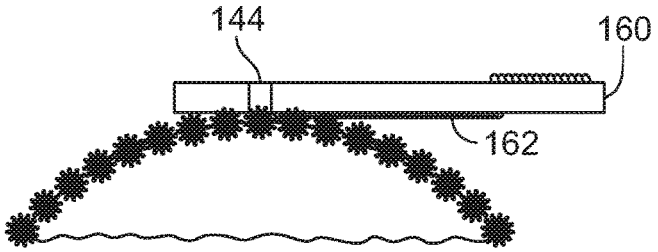
FIG. 33 is a view of the HK strap of FIG. 32 and a partial view of the back of the bear's head taken along lines F-F of FIG. 32.

As shown in FIGS. 32 and 33 HK strap 140 has a top surface hook portion 141 located at or near end 60 and the lower surface of loop portion 162 that extends along the bottom of HK strap 140 in the direction of end 150. Hook portion 141 will extend partially along the length of HK strap 140, but typically no more than 10% of the length of HK strap 140. Loop portion 162 will extend over at least a quarter of the length of long segment of the strap, preferably at least half of the length of the long segment of the strap and may extend over the entire long segment of the strap up to where hook portion 141 begins on the opposite side of strap 140. Thus, loop portion 162 may occupy the middle portion of strap 140 or and may extend to where hook portion 141 starts and/or to end 150.

Figure 35:
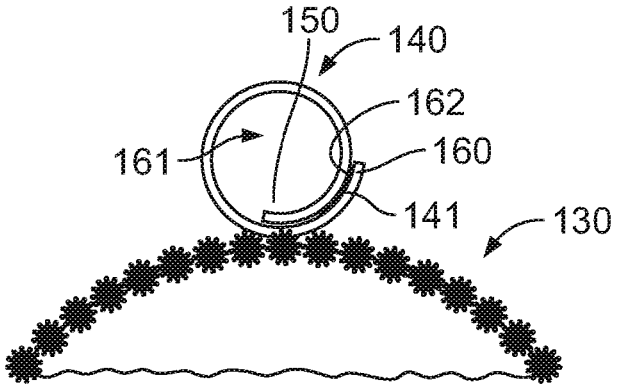
FIG. 35 shows a cross section of the HK strap of FIG. 34 taken at G-G with the strap in a closed position.
Figure 36:
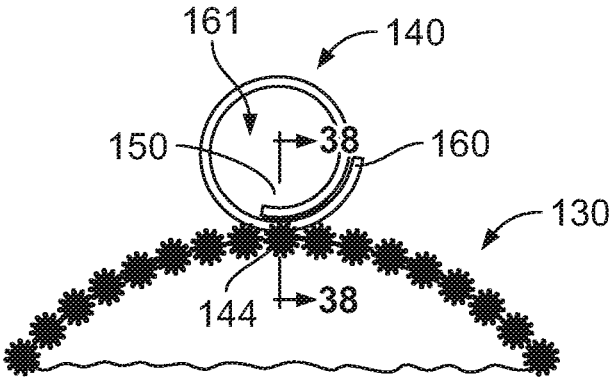
FIG. 36 is a view of the HK strap of FIG. 34 along lines H-H with the strap in a closed position.

FIG. 33 shows HK strap 132 in an open and FIGS. 34-37 provide various views of HK strap 140 in a closed position. FIGS. 33, 34, 36 and 37 further shows the location of tying sections 142 and 144 where HK strap 13 is fixed to bear 130. FIGS. 34-36 show hook portion 144 engaged with loop portion 162 to establish a closed position for HK strap 140 that surrounds an elongate structure (not shown) in the center 161 of the closed HK strap 140.

FIG. 35 shows a sectional view of the closed HK strap taken at section 35 of FIG. 34. This section depicts the circling of strap 140 to close around an elongate structure and the positions of hook portion 160 and when engaged with loop portion 162. It also illustrates end 160 having curled underneath end 150 and above bear 130 so that hook portion 161 can engage loop portion 162. As seen end 160 circles past end 150 to engage hook portion 141 with loop surface 160 at a distance will past end 150.

Figure 37:
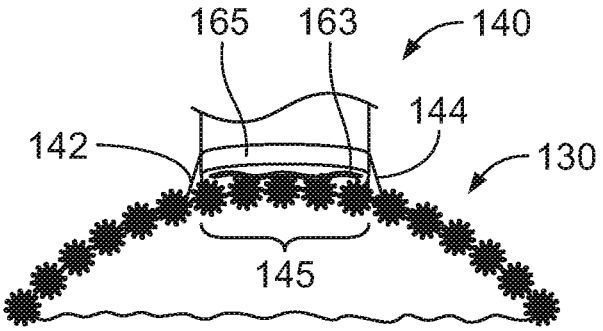
FIG. 37 shows a cross section of the HK strap and accessory taken along lines I-I of FIG. 36.

FIG. 36 shows a view taken along lines 36 of FIG. 34 that depicts end 150 of the closed HK strap 140 and FIG. 37 is a section taken across lines 38 of FIG. 36. FIG. 36 shows the attachment section 144 that secures end 150 on one side of HK strap 140 to bear 130. (Attachment 142 secures end 150 to bear 130 on the opposite side of HK strap 140 as shown in FIGS. 32 and 34.) Together FIGS. 36 and 37 illustrate how HK strap passes through a defined gap 145 bordered by attachment sections 142 and 144 on its sides; bear 130 on its bottom and a portion of HK strap 140 on its top. A portion 163 of HK strap 140 occupies gap 145 when HK strap 140 is in a closed position. HK strap 140 will typically have sufficient deformability to occupy gap 145 which can also expand to accommodate the portion of the HK strap that passes through it. A portion 165 of strap 140 located directly above HK strap portion 163 preferably has a smooth surface to facilitate passage of the HK strap 140 in gap 145 and prevent hook portion 141 from interfering with the passage of HK strap through gap 145.

A portion 165 of strap 140 located directly above HK strap portion 163 preferably has a smooth surface to facilitate passage of the HK strap 140 in gap 145 and prevent hook portion 141 from interfering with the passage of HK strap through gap 145.

Figure 38:
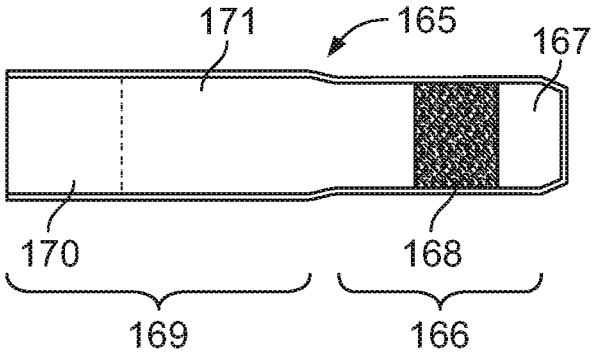
FIG. 38 shows a modified form of the strap for attachment to the accessory.

FIG. 38 shows an HK strap 165 configured to facilitate the use of the strap arrangement depicted by FIGS. 32 to 37. HK strap 165 has wider width portion 169 for securing HK strap 165 to the accessory (bear 130) and a smaller width portion 166 for sliding the hook end of the strap through the gap 145 as described above. The back of the wider portion 169 has a smooth portion 170 under which portion 166 slides when closing HK strap 165 around an elongate object. A hook portion 168 is formed on the top of portion 166 at or near the end of portion 166. Hook portion 168 is set back from the very end of the strap to provide a smooth portion 167 at its very end to facilitate initial sliding of the strap portion 166 through gap 145.

The foregoing description will lead those skilled in the art to recognize additional configurations, embodiments, and/or applications for this invention. For example, those skilled in the art may be inclined to use aspects of the present invention to secure other accessories, i.e. amusing objects and/or ornaments, to shoes. As examples and not limitations the other accessories may include all manner of animals in current existence, imaginary and extinct species, such as dinosaurs; food objects such as pizza, donuts, ice cream cones etc.; every day articles such as a truck, soccer ball, flower, heart, or bow; and symbols such as writings, slogans, a smiley face or other emojis. Those skilled in the art may also be inclined to rearrange the elements of this invention without departing from inventive concepts disclosed herein and accordingly the scope of the present invention is to be limited only to the extent of the following claims.

What is claimed is:

1. An accessory and attachment combination to attach the accessory to an elongate structure comprising:

an accessory;

an elongated and flexible strap affixed to the accessory by two tying sections that are spaced apart transversely to the elongated direction of the strap and located proximate to each other;

a gap defined by the tying sections and the portion of the strap and the portion of the accessory proximate the tying sections wherein the gap is adapted such that a portion of the strap may pass through the gap;

a first joinable element fixed to a first section of the strap; and, a second joinable element fixed to a second section of the strap wherein the second joinable element: is spaced apart from the first joinable element along the length of the strap; is fixed to an opposite side of the strap relative to the first joinable element; and is adapted for engagement with the first joinable element wherein the spacing between the first joinable element and the second joinable element provides sufficient strap length for the strap to pass through the gap and to encircle and fix the accessory to the elongate structure by engagement of the first joinable element and the second joinable element to close the strap around a portion of the elongate structure.

2. The accessory and attachment combination of claim 1 wherein the first joinable element comprises the hook portion of a hook and loop arrangement and the second joinable element comprises the loop portion of a hook and loop arrangement.

3. The accessory and attachment combination of claim 2 wherein the tying sections comprise an adhesive or stitching that extends along a portion of the strap length; the hook portion is located proximate to one end of the strap; and the loop portion is located proximate to the opposite end of the strap.

4. The accessory and attachment combination of claim 1 wherein at least a portion of the strap comprises an elastic material.

5. The accessory and attachment combination of claim 1 wherein the tying sections are located on opposite edges of the strap; most of the length of the strap is located to one side of the tying sections to provide the first section of the strap with a shorter length that the second section of the strap; the second joinable element is fixed proximate to the end of the second section of the strap; and the second joinable element is adapted to pass above the accessory and below the strap at the tying sections and engage the first joinable element on first section of the strap.

6. The accessory and attachment combination of claim 1 wherein each of the tying sections are located along a portion of the opposing edges of the strap.

7. An accessory and attachment combination to attach the accessory to an elongate structure comprising:

an accessory;

an elongated and flexible strap affixed to the accessory at two tying sections that are spaced apart transversely to the elongated direction of the strap and located proximate each other;

a gap defined by the tying sections together with strap and the accessory at the location of the tying sections wherein the gap is adapted such that a portion of the strap may pass through the gap;

a hook portion of a hook and loop arrangement fixed to a first section of the strap; and a loop portion of a hook and loop arrangement fixed to a second section of the strap, wherein the second section of the strap is located on an opposite side of the strap with respect to the location of the hook portion and spaced apart from the hook portion by a sufficient strap length along the strap for the strap to pass through the gap and to encircle and fix the accessory to the elongate structure by passing the second section of the strap, including the loop portion, through the gap and engaging the hook and loop arrangement to close the strap around a portion of the elongate structure.

8. The accessory and attachment combination of claim 7 wherein the tying sections are located along a portion of opposing edges of the strap.

9. The accessory and attachment combination of claim 7 wherein the second section of the strap has a length from the end of the strap proximate to the second section to the tying sections that is less than the length of the first section from the end of the strap proximate to the first section_to the tying sections.

10. The accessory and attachment combination of claim 9 wherein the strap has a reduced width relative to the rest of the strap that begins at the end of the strap associated with the first section and extends along the length of the strap at least a part of the distance to the tying sections to facilitate sliding the first section of the strap including the loop portion underneath the strap between the tying sections.

11. The accessory and attachment combination of claim 7 wherein the tying sections comprise an adhesive or stitching that each partially extend along the length of the strap.

12. The accessory and attachment combination of claim 7 wherein at least a portion of the strap comprises an elastic material.

* * * * *